US006584298B2

(12) United States Patent
Omoto et al.

(10) Patent No.: US 6,584,298 B2
(45) Date of Patent: Jun. 24, 2003

(54) SMALL SIZED FIXING DEVICE CAPABLE OF SECURING A HEAT GENERATION AREA, AND IMAGE FORMING APPARATUS EQUIPPED THEREWITH

(75) Inventors: Tetsuko Omoto, Tokyo (JP); Miho Toyoda, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/005,545

(22) Filed: Oct. 29, 2001

(65) Prior Publication Data

US 2002/0098020 A1 Jul. 25, 2002

(30) Foreign Application Priority Data

Nov. 2, 2000 (JP) ..... 2000-335522

(51) Int. Cl.[7] ..... G03G 15/20
(52) U.S. Cl. ..... 399/330; 219/619; 219/672
(58) Field of Search ..... 399/330, 328; 219/619, 672, 674, 676, 677, 469; 432/60

(56) References Cited

U.S. PATENT DOCUMENTS 6,069,347 A * 5/2000 Genji et al. ..... 399/330
6,255,633 B1 * 7/2001 Takagi et al. ..... 399/330

* cited by examiner

*Primary Examiner*—Joan Pendegrass
(74) *Attorney, Agent, or Firm*—Frishauf, Holtz, Goodman & Chick, P.C.

(57) ABSTRACT

A fixing device includes a heat applying coil formed by winding a wire around the circumference of a coil supporting member disposed along the inside of the cylindrical fixing roller, for heating the fixing roller by inducing an induced current therein, and a pressing roller which forms a nip portion with the fixing roller, and conveys a transfer material gripped by the nip portion between the fixing roller and the pressing roller, thereby fixing a toner image formed on the transfer material by heat energy given from the fixing roller. The heat applying coil is formed by winding a wire so as to have a shape which has parts parallel to the longitudinal direction of the coil supporting member and parts lying along the circumference of the coil supporting member. The winding density of the latter parts is higher than that of the former parts.

18 Claims, 16 Drawing Sheets

FIG. 8
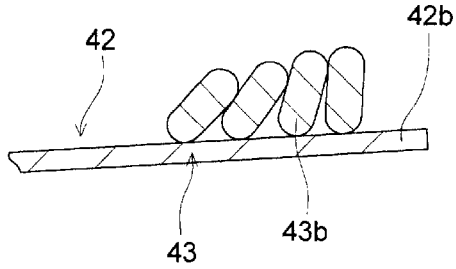
FIG. 9 ( a )
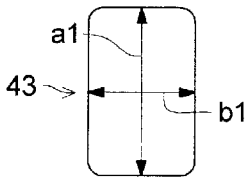
FIG. 9 ( b )
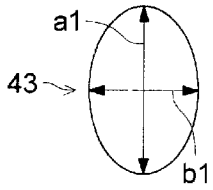
FIG. 9 ( c )
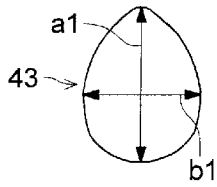

FIG. 24 ( a )
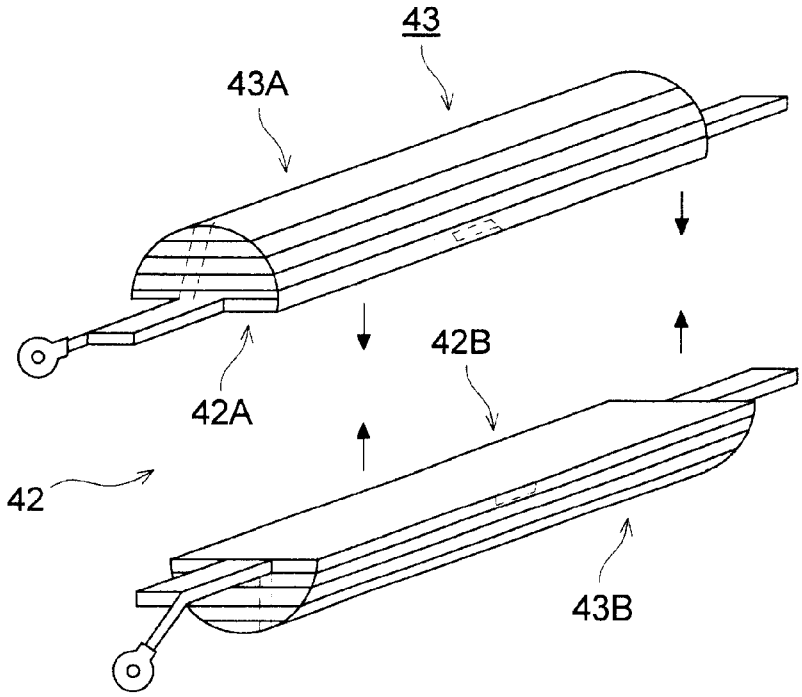
FIG. 24 ( b )
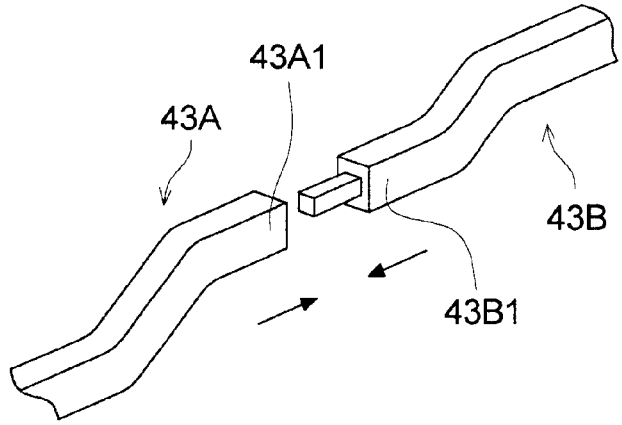

FIG. 25 ( a )
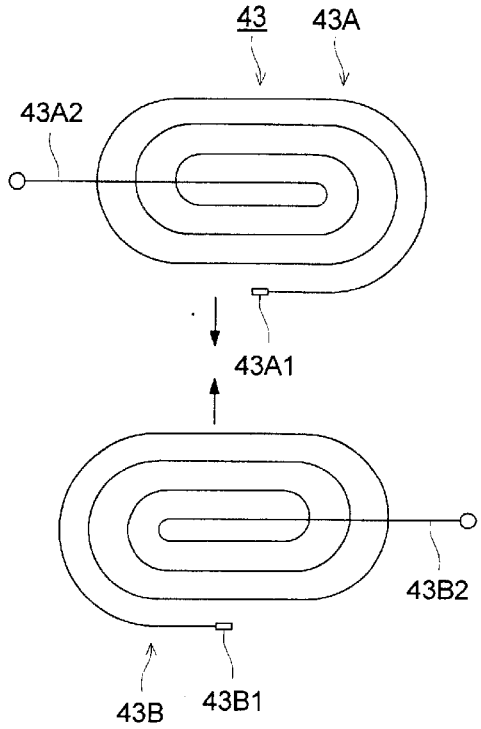
FIG. 25 ( b )
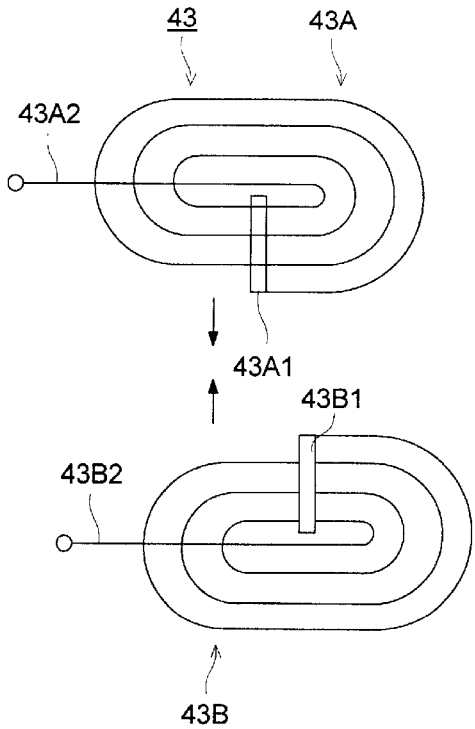

FIG. 28 ( a )
PRIOR ART
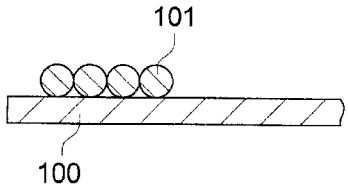
FIG. 28 ( b )
PRIOR ART
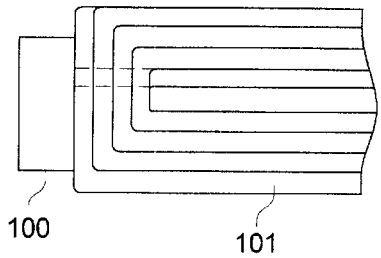
FIG. 29
PRIOR ART
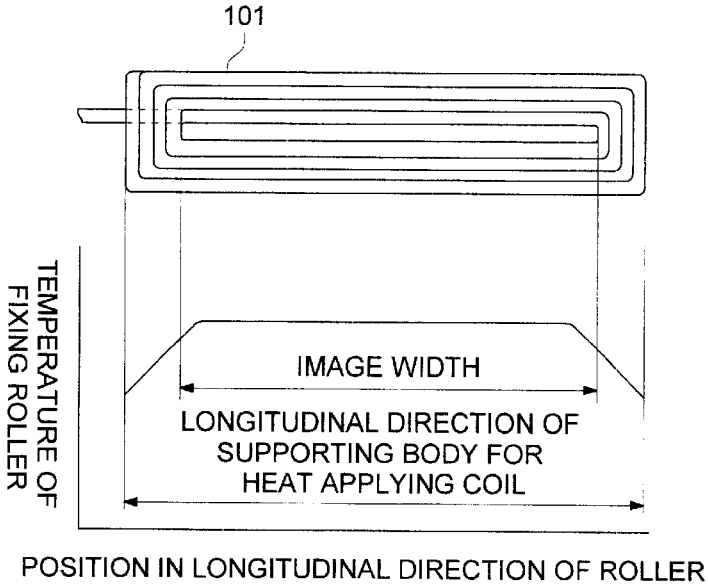

SMALL SIZED FIXING DEVICE CAPABLE OF SECURING A HEAT GENERATION AREA, AND IMAGE FORMING APPARATUS EQUIPPED THEREWITH

BACKGROUND OF THE INVENTION

This invention relates to a fixing device of an induction heating type for use in an image forming apparatus such as a copying machine, a printer, and a facsimile machine and an image forming apparatus equipped with this fixing device.

Up to now, a fixing device for use in an image forming apparatus such as a copying machine, a printer, and a FAX machine has a structure such that a heating roller for heating a transfer material carrying a toner image composed of a powder developer and a pressing roller for conveying and pressing it are provided, and the toner particles on this transfer material are fused and melted to be fixed on it by the passage of the transfer material through the fixing point which is the pressing contact portion (nip portion) of these heating roller and pressing roller.

A generally known fixing device uses a halogen lamp, which is provided inside a metallic roller to heat the roller by radiant heat, as a heat source of the heating roller. However, in recent years, as a fixing device employing a technique of induction heating, there has been proposed a method of heating in which an eddy current is made to flow in a fixing roller in a structure having a shape composed of a coil supporting member provided along the rotary axis of the fixing roller having a heat applying coil wound round on it.

Such a fixing device is capable of making the position of heat generation come as close as possible to toner particles by generating an eddy current in the fixing roller by a magnetic flux to generate heat based on Joule's heat, and is also capable of achieving improved efficiency of energy consumption as compared to a heating roller employing a halogen lamp. In addition, such a fixing device is capable of performing temperature control easily and with a high precision.

However, as shown in FIG. 28(*a*) and FIG. 28(*b*), in the case where a heat applying coil 101 is uniformly wound around a coil supporting member 100, as shown in FIG. 29, the magnetic flux density is small at both ends of the fixing roller in the longitudinal direction. As a result, heat generation is decreased to cause a temperature drop to occur, which produces poor fixing.

By making the length of the fixing roller longer than the part that is required for fixing in order to get rid of the problem of this temperature drop, the temperature of the part that is required for fixing is secured. In that case, however, the length of the heat applying coil becomes long, electric power consumption becomes high, and it is not possible to make the size compact, which causes the device to have a large size. Further, there is a problem that, for example, manufacturing cost is increased because the heat applying coil and the supporting member must be made large-sized.

SUMMARY OF THE INVENTION

This invention was made in view of the above-mentioned points, and it is an object to provide a fixing device and an image forming apparatus which are capable of securing the heat generation area with a simple structure, and which can be made small in size and at a low manufacturing cost.

For the purpose of solving the above-mentioned problems and accomplishing the object, this invention has any one of the structures described below.

A fixing device according to a first aspect of the invention comprises a cylindrical fixing roller to be heated, a coil supporting member disposed along the inside of this fixing roller, a heat applying coil formed by winding a wire round on the circumference of this coil supporting member for heating the fixing roller by inducing an induced current in the fixing roller, and a pressing roller that forms a nip portion with the fixing roller, conveys a transfer material which is gripped by the nip portion between the fixing roller and the pressing roller, and a toner image formed on the transfer material being fixed by heat energy given from the fixing roller, characterized in that the heat applying coil is formed by winding a wire round in such a way as to have a shape which is longer in the longitudinal direction of the coil supporting member and parts parallel to the longitudinal direction of the coil supporting member and parts lying along the circumference of the coil supporting member, and with respect to this heat applying coil, the winding density of the parts lying along the circumference of the coil supporting member is made higher than the winding density of the parts parallel to the longitudinal direction of the coil supporting member.

According to this aspect of the invention, by making the winding density of the parts of the heat applying coil lying along the circumference of the coil supporting member higher than the winding density of the parts of the heat applying coil parallel to the longitudinal direction of the coil supporting member, the magnetic flux density at the end portions in the longitudinal direction of the fixing roller is made higher, and heat generation becomes higher accordingly; thus, the distribution of heat generation in the fixing roller is improved thereby making possible to suppress the temperature drop at the end portions in the longitudinal direction, and it is possible that the length of the heat applying coil is made as short as possible, a sufficient heat generation area is secured with a simple structure, and the size is made small and the manufacturing cost is lowered.

According to a second aspect of the invention, the wire of the heat applying coil has a cross-sectional shape such that the lengths of the vertical axis and the lateral axis intersecting each other perpendicularly at the center are different, and the heat applying coil is formed by winding the wire round in such a way that, in the parts parallel to the longitudinal direction of the coil supporting member, the long axes of the wire cross-section are directed to one another, and in the parts lying along the circumference of the heat applying coil, the short axes of the wire cross-section are directed to one another.

According to the second aspect of the invention, by forming the coil in such a way that, in the parts of the heat applying coil parallel to the longitudinal direction of the coil supporting member, the long axes of the wire cross-section are directed to one another, and in the parts lying along the circumference of the coil supporting member, the short axes of the wire cross-section are directed to one another, the magnetic flux density at the end portions in the longitudinal direction of the fixing roller is made higher, and heat generation becomes higher accordingly; thus, the distribution of heat generation in the fixing roller is improved thereby making it possible to suppress the temperature drop at the end portions in the longitudinal direction, and it is possible that the length of the heat applying coil is made as short as possible, a sufficient heat generation area is secured with a simple structure, and the size is made small and the manufacturing cost is lowered.

According to a third aspect of the invention, a fixing device is provided wherein, with respect to the heat applying coil, the number of stacked layers are different between the parts of the heat applying coil parallel to the longitudinal direction of the coil supporting member and the parts of the heat applying coil lying along the circumference of the coil supporting member, and the number of stacked layers in the parts of the heat applying coil lying along the circumference of the coil supporting member is made greater than the number of stacked layers in the parts of the heat applying coil parallel to the longitudinal direction of the coil supporting member.

According to the third aspect of the invention, by making the number of stacked layers in the parts of the heat applying coil lying along the circumference of the coil supporting member greater than the number of stacked layers in the parts of the heat applying coil parallel to the longitudinal direction of the coil supporting member, the magnetic flux density at the end portions in the longitudinal direction of the fixing roller is made higher, and heat generation becomes higher accordingly; thus, the distribution of heat generation in the fixing roller is improved thereby making it possible to suppress the temperature drop at the end portions in the longitudinal direction, and it is possible that the length of the heat applying coil is made as short as possible, a sufficient heat generation area is secured with a simple structure, and the size is made small and the manufacturing cost is lowered.

According to a fourth aspect of the invention, a fixing device is provided wherein, with respect to the heat applying coil, the distance between the outer surface of the wire in the parts of the heat applying coil lying along the circumference of the coil supporting member and the inner surface of the fixing roller is made shorter than the distance between the outer surface of the wire in the parts of the heat applying coil parallel to the longitudinal direction of the coil supporting member and the inner surface of the fixing roller.

According to the fourth aspect of the invention, by making the distance between the outer surface of the wound wire in the parts of the heat applying coil lying along the circumference of the coil supporting member and the inner surface of the fixing roller shorter than the distance between the outer surface of the wound wire in the parts of the heat applying coil parallel to the longitudinal direction of the coil supporting member and the inner surface of the fixing roller, the magnetic flux density at the end portions in the longitudinal direction of the fixing roller is made higher, and heat generation becomes higher accordingly; thus, the distribution of heat generation in the fixing roller is improved thereby making it possible to suppress the temperature drop at the end portions in the longitudinal direction, and it is possible that the length of the heat applying coil is made as short as possible, a sufficient heat generation area is secured with a simple structure, and the size is made small and the manufacturing cost is lowered.

According to a fifth aspect of the invention, the lead wires of the heat applying coil are disposed inside the winding of the heat applying coil.

According to the fifth aspect of the invention, by disposing the lead wires of the heat applying coil inside the winding of the heat applying coil, the lead wires do not stand in the way of the heat applying coil to be wound round, and on top of it, they are easily connected to a power source.

According to a sixth aspect of the invention, the coil supporting member is heat resistant, and its both ends are supported fixedly.

According to the sixth aspect of the invention, by making the coil supporting member heat resistant and its both ends supported fixedly, the durability of the coil supporting member is improved.

According to a seventh aspect of the invention, the lead wires of the heat applying coil are fixed to the coil supporting member, and are drawn out from one side of the coil supporting member in the longitudinal direction, to be connected to a power source.

According to the seventh aspect of the invention, by making the lead wires of the heat applying coil fixed to the coil supporting member and drawn out from one side of the coil supporting member in the longitudinal direction, the lead wires can be connected to a power source simply and certainly, and on top of it, the efficiency of operation in assembly is improved.

According to an eighth aspect of the invention, a heat insulating layer is formed between the heat applying coil and the fixing roller.

According to the eighth aspect of the invention, by forming a heat insulating layer between the heat applying coil and the fixing roller, heat radiation from the fixing roller is decreased, which makes possible stable fixing and reduction of power consumption.

According to a ninth aspect of the invention, the coil supporting member is a heat conducting material and has means for radiating heat of the heat applying coil.

According to the ninth aspect of the invention, by making the coil supporting member thermally conductive to radiate heat of the heat applying coil, the durability of the coil supporting member and the heat applying coil can be improved.

According to a tenth aspect of the invention, the coil supporting member is composed of half-divisional parts which are obtained by dividing the coil supporting member into two parts along its longitudinal direction, two parts of the heat applying coil are formed by winding wires round on the respective half-divisional parts from inner side to the outer side in such a way that the terminals at the start of winding come to the inner side, the both half-divisional parts are bonded to each other, and the one and the other of the ends of winding at the outside of the heat applying coils are connected to each other.

According to the tenth aspect of the invention, by winding round wires of the heat applying coil on the half-divisional parts respectively from the inner side to the outer side, in such a way that the terminals at the start of winding come to the inner side, to build two winding units, bonding the both half-divisional parts to each other, and connecting the one and the other of the ends of winding at the outer side of the heat applying coils to each other, they are easily built and the efficiency of the operation of assembly is improved.

According to an eleventh aspect of the invention, an image forming apparatus is provided in which a uniformly charged photoreceptor drum is imagewise exposed, a latent image is formed on the photoreceptor drum, this latent image is developed to form a toner image, this toner image is transferred onto a transfer material, and the toner image is fixed, characterized in that the image forming is equipped with one of the above-described fixing devices to fix the toner image on the transfer material.

According to the eleventh aspect of the invention, by being equipped with a fixing device that is small-sized, of low cost, and capable of securing a sufficient heat generating area, the image forming apparatus can also be made small-sized and of low cost.

BRIEF DESCRIPTION OF THE DRAWINGS

FIG. 8 is a drawing showing the way of winding of a part of a heat applying coil lying along the circumference of the coil supporting member;

FIG. 9(*a*) to FIG. 9(*c*) are drawings showing the cross-sectional shapes of wires of heat applying coils;

FIG. 24(*a*) and FIG. 24(*b*) are drawings showing another example of the embodiment of this invention of a state in which a heat applying coil is formed by winding a wire round on a coil supporting member;

FIG. 25(*a*) and FIG. 25(*b*) are drawings showing how two parts of a heat applying coil are connected to each other to form an integral coil;

FIG. 28(*a*) and FIG. 28(*b*) are drawings showing a state in which a conventional heat applying coil is formed by winding a wire round on a coil supporting member; and FIG. 29 is a drawing showing a temperature distribution in the longitudinal direction of a conventional fixing roller.

DETAILED DESCRIPTION OF THE PREFERRED EMBODIMENT

In the following, an embodiment of a fixing device and an image forming apparatus of this invention will be explained. The explanation which follows describes only an example, and is not intended to limit the meaning of the terms and the technical scope of the invention as set forth in the claims.

Figure 1:
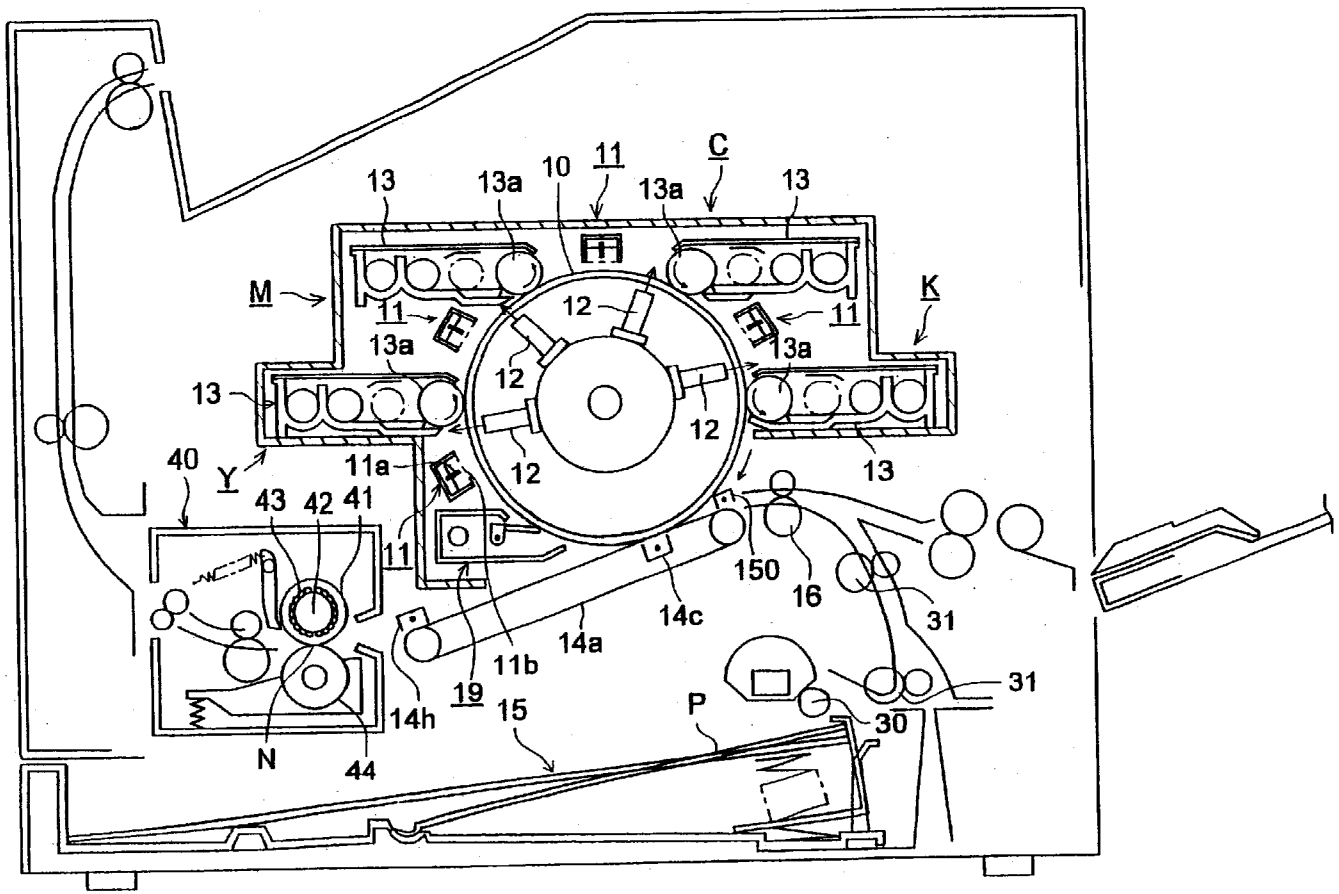
FIG. 1 is a cross-sectional view of the structure of a color image forming apparatus showing an example of the embodiment of an image forming apparatus using a fixing device.

By referring to FIG. 1, it will be explained an image forming process and each of mechanisms of an example of an embodiment of an image forming apparatus employing a fixing device according to this invention. FIG. 1 is a cross-sectional view of the structure of a color image forming apparatus showing an example of the embodiment of an image forming apparatus using a fixing device.

In an image forming apparatus of this example of the invention, a photoreceptor drum 10 as an image forming member has a photoconductive layer composed of an organic photosensitive layer (OPC) and a light transmitting conductive layer formed on the circumference of a cylindrical base member which is formed of a light transmitting material such as, for example, a glass or a light transmitting acrylic resin.

The photoreceptor drum 10 is rotated in the clockwise direction shown by the arrow mark in FIG. 1 by a driving force from a drive source with its light transmitting conductive layer grounded. In this invention, an arbitrary exposure light beam for image exposure is appropriate so long as it has light quantity for exposure of a wavelength capable of giving a suitable contrast in respect of a photo-induced decay characteristic (generation of photo-induced charge carriers) of the photoconductor layer of the photoreceptor drum 10 positioned at the image forming point of the light beam. Hence, it is not necessary that the light transmittance of the light transmitting base member of the photoreceptor drum 10 is 100%, but it is also possible for it to have a characteristic to absorb light to some extent in transmitting the exposure light beam. The essential point is that it can give a suitable contrast. For the material of the light transmitting base member, an acrylic resin, in particular, one obtained by polymerization of a monomer of methylmethacrylate ester is excellent in light transmitting property, mechanical strength, precision in working, surface property, etc., and is used desirably; however, it is possible to use various kinds of light transmitting resins such as an acrylic, a fluorine-contained, a polyester, a polycarbonate, and a polyethylene terephthalate resin. Further, it may be colored so long as it has light transmitting ability for the exposure light. For the light transmitting conductive layer, a thin film of indium-tin oxide, tin oxide, lead oxide, indium oxide, copper iodide, and a metallic thin film maintaining light transmitting ability composed of Au, Ag, Ni, Al, or the like can be used; for the method of forming a film, a vacuum evaporation method, an active reaction evaporation method, various kinds of sputtering methods, various kinds of CVD methods, a dip coating method, a spray coating method, etc. can be utilized. Further, for the photoconductive layer, various kinds of organic photosensitive layer (OPC) can be used.

The organic photosensitive layer as a photosensitive layer is one composed of two layers with its functions shared separately between a charge generating layer (CGL) mainly composed of a charge generating material (CGM) and a charge transporting layer mainly composed of a charge transporting material (CTM). The organic photosensitive layer composed of two layers has a high durability as an organic photosensitive layer.

A scorotron charging device 11 as a charging means, an exposure optical system 12 as an image writing means, and a developing device 13 as a developing means are provided for each of the image forming processes of the colors yellow (Y), magenta (M), cyan (C), and black (K), and in this example of the embodiment, they are arranged in the order of Y, M, C, and K with respect to the rotating direction of the photoreceptor drum 10 shown by the arrow mark in FIG. 1.

The scorotron charging device 11 as a charging means is arranged opposite to and close to the photoreceptor drum 10 as an image forming member with an orientation perpendicular to the moving direction of the photoreceptor drum 10 (in the direction perpendicular to the page in FIG. 1), and using a control grid llb which is kept at a specified electrical potential to the organic photosensitive layer of the photoreceptor drum 10 and, for example, a sawtooth electrode for a corona discharge electrode lla, carries out charging action by corona discharge of the same polarity as the toner, to give a uniform electrical potential to the surface of the photosensitive layer. For the corona discharge electrode 11*a*, also it is possible to use an electrode other than the above-mentioned such as a wire electrode or a needle electrode.

The exposure optical system 12 for each of the colors is made up as an exposure unit which has a line-shaped exposure device (not shown in the drawing) with a plurality of elements arrayed parallel to the axis of the photoreceptor drum 10 and a SELFOC lens (not shown in the drawing) as an image forming device with one to one magnification attached to a holder. The exposure optical system for each of the colors is attached to a cylindrical holder 20 as an exposure optical system holding member, and is housed inside the base member of the photoreceptor drum 10. For the exposure device, a line-shaped device other than the above-mentioned one having arrayed a plurality of light emitting elements such as FL elements (fluorescent emission), EL elements (electroluminescence), or PL elements (plasma discharge) can be used.

The exposure optical system 12 as an image writing means for each of the colors is arranged inside the photoreceptor drum 10 with its exposure position provided between the scorotron charging device 11 and the developing device 13 in the upstream side of the developing device 13 in respect of the rotating direction of the photoreceptor drum 10.

The exposure optical system 12 carries out image exposure for the uniformly charged photoreceptor drum 10, on the basis of image data for each of the colors which have been transmitted from a separately provided computer (not shown in the drawing) and memorized in a memory, after the image processing of the image data, to form a latent image on the photoreceptor drum 10. For the light emission wavelength of the light emitting elements used in this example of the embodiment, one falling within a range from 680 nm to 900 nm, for which Y, M, and C toners usually have a high transmittance, is satisfactory; however, because image exposure is done from the rear side, shorter wavelengths than this for which the color toners have not a transmittance enough may be also used.

Each of the developing devices 13 as a developing means for each of the colors contains inside the pertinent one of the two-component developers (may be a single-component ones) of yellow (Y), magenta (M), cyan (C), and black (K), and is provided with a cylindrical developing sleeve 13*a* as a developer carrier having, for example, a thickness of 0.5 to 1 mm and an outer diameter of 15 to 20 mm formed of a nonmagnetic stainless steel or an aluminum material.

In the developing area, the developing sleeve 13*a* is kept in non-contact with the photoreceptor drum 10 at a specified spacing, for example, 100 to 1000 $\mu$m to it by a rolling spacer (not shown in the drawing), and is designed to revolve in the same direction as the moving direction of the photosensitive layer of the photoreceptor drum 10 at the closest position to it; at the time of development, by applying a development bias voltage composed of a direct current voltage of the same polarity as the toners or the direct current voltage with an overlapping alternate current voltage to the developing sleeve 13*a*, toner deposition by non-contact reverse development is made for the exposed parts of the photoreceptor drum 10. For the precision of the development spacing at this time, 20 $\mu$m or under is required in order to prevent unevenness of image.

The developing device 13 reversely develops an electrostatic latent image on the photoreceptor drum 10 formed through the charging by the scorotron charging device 11 and the image exposure by the exposure optical system 12 in a state of non-contact with a toner having the same polarity as the charge of the photoreceptor drum 10.

When image formation is started, by the actuation of the image forming member driving motor (not shown in the drawing), the photoreceptor drum 10 is rotated in the clockwise direction shown by the arrow mark in FIG. 1, and at the same time, giving of an electrical potential to the photoreceptor drum 10 is started by the charging action of the scorotron charging device 11 for Y. After given an electrical potential, the photoreceptor drum 10 is subjected to the start of exposure (image writing) by the first color signal, that is, an electrical signal corresponding to the image data of Y, and an electrostatic latent image corresponding to the image of yellow (Y) of the original image is formed on the photosensitive layer at the surface of the photoreceptor drum 10 through the scanning by its revolution. This latent image is.reversely developed in a state of non-contact by the developing device 13 for Y, to form a toner image of yellow (Y) on the photoreceptor drum 10.

Next, the photoreceptor drum 10 is given an electrical potential on the above-mentioned toner image of yellow (Y) by the charging action of the scorotron charging device 11 for M, and is subjected to the exposure (image writing) based on the second color signal, that is, an electrical signal corresponding to the image data of magenta (M), to form a toner image of magenta (M) overlapping the above-mentioned toner image of yellow (Y) through the reverse development by the developing device 13 for M.

Through similar processes, a toner image of cyan (C) corresponding to the third color signal and a toner image of black (K) corresponding to the fourth color signal are successively formed respectively by the scorotron charging device 11, the exposure optical system 12, and the developing device 13 for C and the scorotron charging device 11, the exposure optical system 12, and the developing device 13 for K with the former ones overlapped, resulting in the formation of a color toner image on the circumferential surface of the photoreceptor drum 10 within one rotation of it.

As described in the above, in this example of the invention, the exposures for the organic photosensitive layer of the photoreceptor drum 10 by the respective optical systems 12 for Y, M, C, and K are carried out from the inside of the photoreceptor drum 10 through the light transmitting base member. Hence, it is possible that all the exposures by the images corresponding to the second, the third, and the fourth color signals respectively are not intercepted by the previously formed toner images to form an electrostatic latent image; this is desirable; however, also it is possible to make an exposure from the outside of the photoreceptor drum 10.

On the other hand, a recording paper sheet P as a transfer material is conveyed out from a paper feeding cassette 15 as a transfer material containing means by a conveying-out roller 30, is fed by feed rollers 31, and is conveyed to a timing roller 16.

The recording paper sheet P is synchronized with the color toner image carried on the photoreceptor drum 10 by the driving of the timing roller 16, and is attracted to the conveyance belt 14*a* by the charging of the paper charging device 150 as a paper charging means, to be fed to a transfer zone. The toner images making up a color toner image on the circumferential surface of the photoreceptor drum 10 are all transferred together to the recording paper sheet P, which has been conveyed as close attracted by the conveyance belt 14*a*, by a transfer device 14*c* to which a voltage with a polarity opposite to that of the toner in a transfer area is applied.

The recording paper sheet P, which has a color toner image transferred onto it, is subjected to charge elimination by an AC charge eliminating device for paper detaching 14*h* as a transfer material detaching means, is detached from the conveyance belt 14*a*, and is conveyed to a fixing device 40.

The fixing device 40 comprises a cylindrical fixing roller 41 to be heated, a coil supporting member 42 disposed along the inside of this fixing roller 41, a heat applying coil 43 formed by winding a wire round on the circumference of this coil supporting member 42 for inducing an induced current in the fixing roller 41 to heat it, and a pressing roller 44 for forming a nip portion N with the fixing roller 41, and through conveying a recording paper sheet as gripped by the nip portion N between the fixing roller 41 and the pressing roller 44, heat energy is given to the toner image formed on the recording paper sheet P to fix the image.

The fixing roller 41 is formed of a conductive member such as an iron tube, stainless alloy tube, a nickel tube, a carbon steel tube, or an aluminum alloy tube, and has a heat resistant releasing layer formed on its outer circumferential surface by coating it with a fluorine-contained resin. it is more desirable to form the fixing roller 41 of a conductive magnetic member.

Further, the fixing roller 41 has a structure as a soft roller having an outer diameter of 25 to 50 mm composed of, for example, a cylindrical thermally conductive base member, and an elastic heat insulating layer having a high elasticity, a magnetic elastic heat generating layer having magnetic particles mixed therein, and a protective layer provided in the above-mentioned order on the outside of the thermally conductive base member.

For the cylindrical thermally conductive base member, one having a thickness of 0.5 to 3 mm made of an aluminum material with a good thermal conductivity (thermal conductivity: 2.38 J/cm.s.K, volume resistivity: $2\times10^{-8}$ Ω.cm), or a non-magnetic stainless steel material (thermal conductivity: 2.25 J/cm.s.K, volume resistivity: up to $5\times10^{-8}$ Ω.cm) is mainly used. Because the thermally conductive base material has a comparatively small thickness, a nonmagnetic material having a good thermal conductivity is used. For the elastic heat insulating layer, a base rubber (base layer) having a thickness of 0.2 to 2 mm, or desirably 0.5 to 1.5 mm made of, for example, a silicone rubber (thermal conductivity: $1.0\times10^{-3}$ J/cm.s.K), a fluorine-contained rubber (thermal conductivity: $5.0\times10^{-4}$ J/cm.s.K), or the like is used; it is formed of a base rubber as an elastic high molecular material capable of transmitting magnetic lines of force which transmits magnetic lines of force.

For the elastic heat insulating layer, it is employed a method to improve the thermal conductivity by adding powders of metal oxides such as silica, alumina, and magnesium oxide as a filler in the base rubber (silicone rubber or fluorine-contained rubber) as an elastic high molecular material; it is desirable to make a base layer having a thermal conductivity of (1 to 10)$\times^{10-3}$ J/cm.s.K or so. This base layer performs a role of a heat insulating layer owing to its thermal conductivity being lowered than that of the thermally conductive base member made of an aluminum material (thermal conductivity: 2.38 J/cm.s.K) or a non-magnetic stainless steel material (thermal conductivity: 0.25 J/cm.s.K). It is desirable to make the thermal conductivity of the elastic heat insulating layer not higher than a half, or more desirably 1/10, of the thermal conductivity of the thermally conductive base member. A desirable rubber hardness of the elastic heat insulating layer is 5 to 60 Hs.

For the magnetic elastic heat generating layer, it is used a composition obtained by blending magnetic particles composed of fine particles of metallic ferromagnetic substances such as iron, chromium, nickel, and cobalt, a conductive carbon black such as Ketjenblack-EC, Calbolacl, Vulcan-XC72, or acetylene black for adjusting volume resistivity, and further, powders of metal oxides such as silica, alumina, and magnesium oxide as a filler for coping with high-speed-making, in a base rubber (in a rubber solution to compose the base rubber) as an elastic high molecular material (binder) such as a silicone rubber (thermal conductivity: $1.0\times10^{-3}$ J/cm.s.K), a fluorine-contained rubber (thermal conductivity: $5.0\times10^{-4}$ J/cm.s.K).

For the magnetic particles to be mixed in the rubber solution for the magnetic elastic heat generating layer, iron powders are desirably used; they are classified into reduced iron powders, atomized iron powders, nitride iron powders, etc. on the basis of the method of manufacturing. Because the reduced iron powders and the nitride iron powders are indefinite-shaped, it is desirable to apply spheroidizing treatment to them. Further, it is desirable that, in order to prevent rust, iron powders are previously subjected to a oxidation treatment to a light degree or to a surface treatment for raising the dispersion ability in the rubber solution before polymerization. Further, iron powders are desirable owing to its low resistivity and large magnetization.

The coil supporting member is, for example, a magnetic core formed of a metal; by the magnetic lines of force generated by the heat applying coil 43, an alternate current magnetic field of about 0.5 to 50 kHz is formed inside the magnetic elastic heat generating layer of the fixing roller 41, to heat the magnetic elastic heat generating layer.

For the heat applying coil 43, it is desirable to use a single or litz copper wire having a fused layer and an insulating layer on the surface.

The pressing roller 44, the lower one to make a pair with the fixing roller 41, has a structure as a soft roller composed of a metallic core made of aluminum material for example, and a rubber roller layer made up of a thick rubber layer, which is like a sponge made of a silicone rubber layer, fluorine-contained rubber layer, or a foamed material of a silicone rubber, and has a thickness of 5 to 20 mm and a rubber hardness of 10 Hs to 40 Hs (JIS, rubber hardness A), formed on the outer circumference of the metallic core. It may have a structure such that the outer side (outer circumferential surface) is covered with a heat resistant tube (not shown in the drawing) made of a fluorine-contained resin such as PFA or PTFA having a releasing property.

Figure 2:
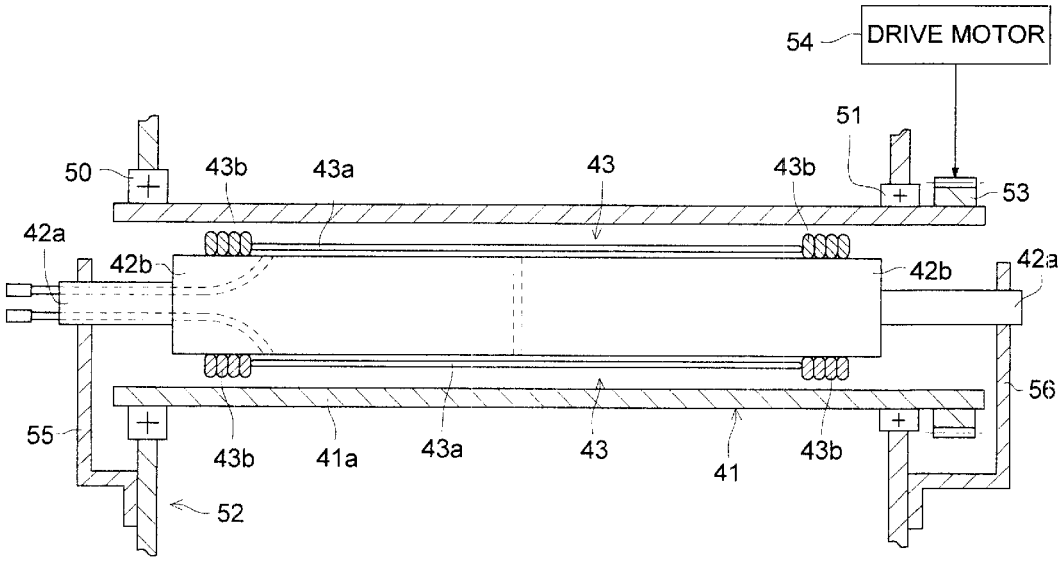
FIG. 2 is a cross-sectional view of a fixing device.
Figure 3:
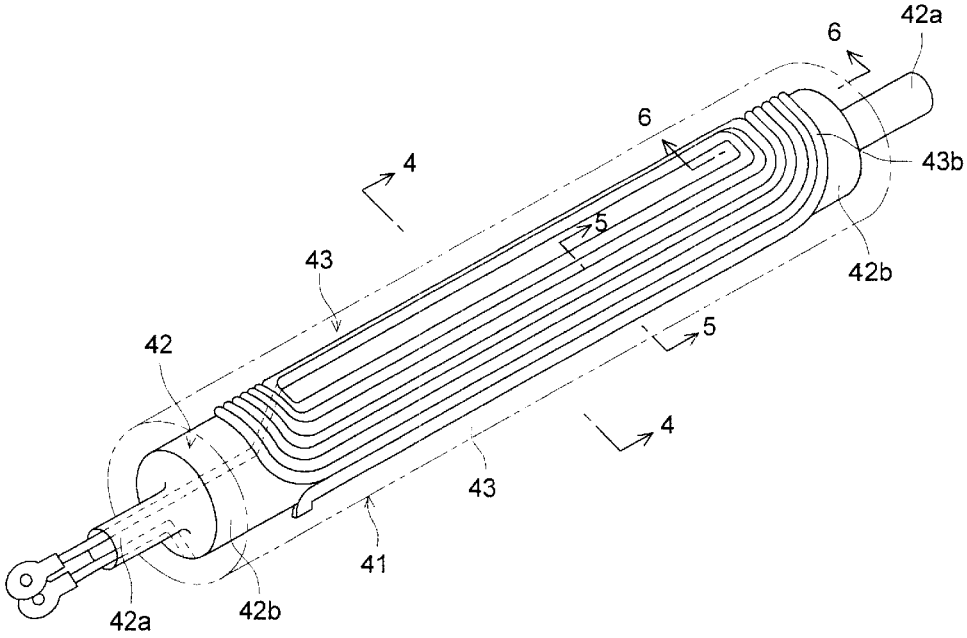
FIG. 3 is a perspective view showing a state in which a heat applying coil is formed by winding a wire round on a coil supporting member.
Figure 4:
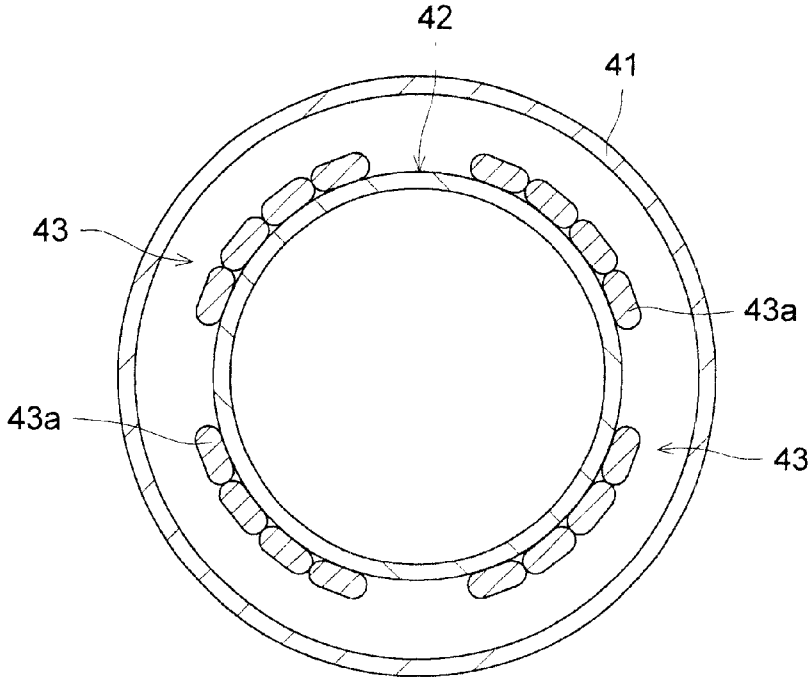
FIG. 4 is the cross-sectional view at the line 3—3 in FIG. 3.
Figure 5:
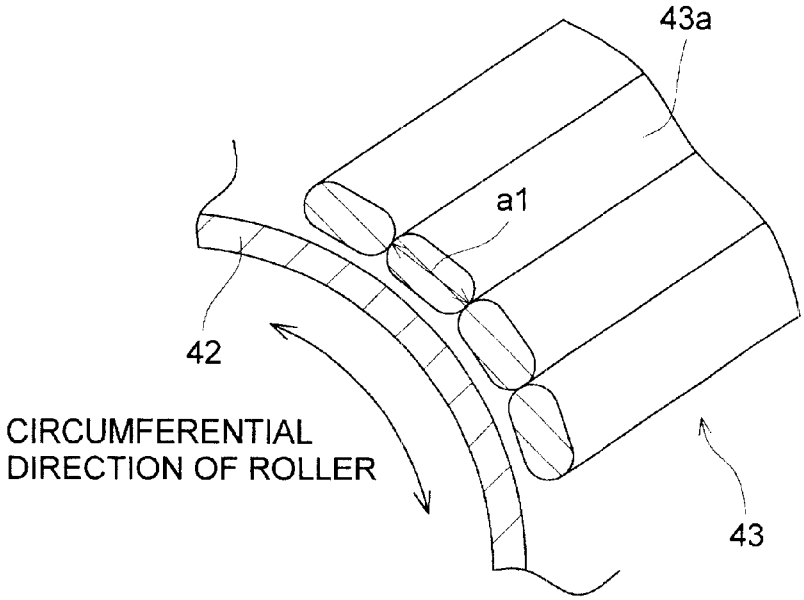
FIG. 5 is the cross-sectional view at the line 4—4 in 3.
Figure 6:
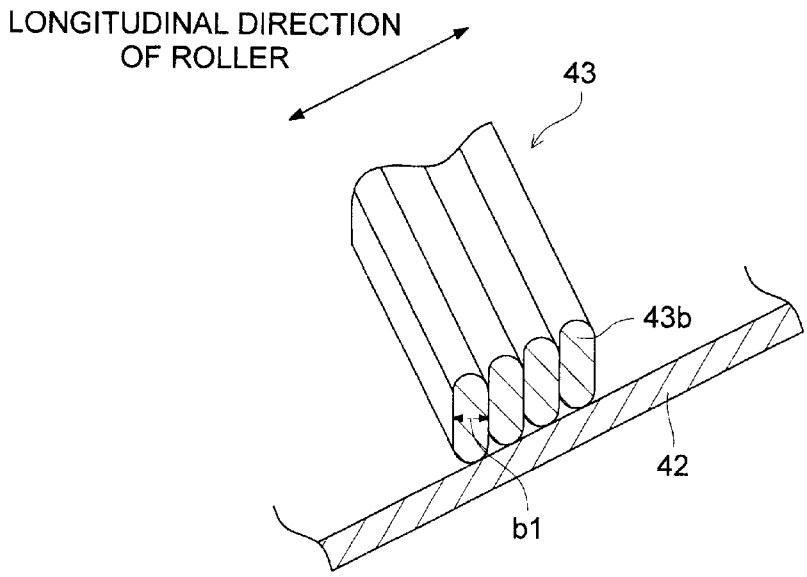
FIG. 6 is the cross-sectional view at the line 5—5 in FIG. 3.
Figure 7:
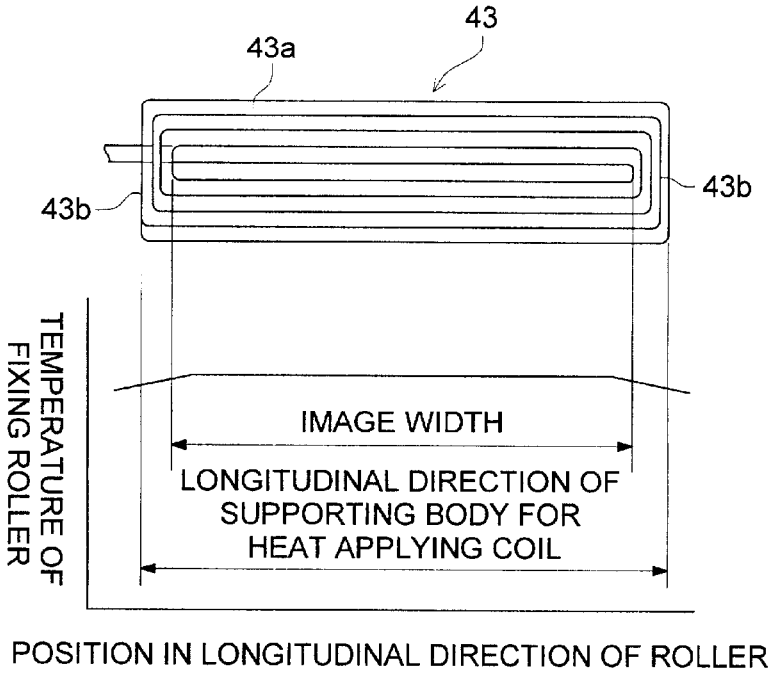
FIG. 7 is a drawing showing a temperature distribution in the longitudinal direction of a fixing roller.

Next, the fixing device of this example of the invention will be explained on the basis of FIG. 2 to FIG. 7. FIG. 2 is a cross-sectional view of a fixing device, FIG. 3 is a perspective view showing a state where a heat applying coil is formed by winding a wire round on a coil supporting member, FIG. 4 is the cross-sectional view at the line 4—4 in FIG. 3, FIG. 5 is the cross-sectional view at the line 5—5 in FIG. 3, FIG. 6 is the cross-sectional view at the line 6—6 in FIG. 3, and FIG. 7 is a drawing showing a temperature distribution in the longitudinal direction of a fixing roller.

In this fixing device 40, the fixing roller 41 is supported rotatably by the main body 52 of the fixing device through bearings 50 and 51, and at the one end of this fixing roller 41, there is provided a drive gear 53, which is driven by the driving force of a drive motor 54.

The coil supporting member 42 is heat resistant, is formed cylindrically, and is disposed along the inside of the fixing roller 41. Support portions 42*a* at the both ends of this coil supporting member 42 are projected and supported fixedly by the main body 52 of the fixing device through supporting plates 55 and 56 respectively. Because the coil supporting member 42 is heat resistant, and its both ends are supported fixedly, the durability of the coil supporting member 42 is made high.

The heat applying coil 43 is formed by winding a wire round on the outer surface of the coil supporting member 42 at the symmetrical positions with respect to a plain passing through an axis of the coil supporting member 42, in such a way that it has a shape which is longer along the longitudinal direction of the coil supporting member 42 and has parts parallel to the longitudinal direction of the coil supporting member 43*a* and parts lying along the circumference of the coil supporting member 43*b*. With respect to this heat applying coil, the winding density of the parts lying along the circumference of the coil supporting member 43*b* is made higher than the winding density of the parts parallel to the longitudinal direction of the coil supporting member 43*a*.

As a means for making the winding density of the parts lying along the circumference of the coil supporting member 43*b* higher than the winding density of the parts parallel to the longitudinal direction of the coil supporting member 43*a*, in this example of the embodiment, the cross-sectional shape of the wire of the heat applying coil 43 is made to have a shape of an elongated circle having two straight sides which are parallel to each other, that is, a shape with different lengths of the vertical axis and the lateral axis crossing each other at the center of the cross-section, and in the parts parallel to the longitudinal direction of the coil supporting member 43*a*, as shown in FIG. 5, the wire is wound in such a way that the long axis al is parallel to the tangent of the circumference of the coil supporting member at the position, and in the parts lying along the circumference of the coil supporting member 43*b*, the wire is wound in such a way that the short axis bl is parallel to the tangent of the circumference of the coil supporting member at the position.

As described in the above, by making the winding density of the parts lying along the circumference of the coil supporting member 43*b* higher than the winding density of the parts parallel to the longitudinal direction of the coil supporting member 43*a*, the density of magnetic flux at the end portions 41*a* in the longitudinal direction of the fixing roller 41 is made high and heat generation is increased to a degree depending on it; as shown in FIG. 7, the distribution of heat generation in the fixing roller 41 is improved, which makes it possible to suppress the temperature drop at the both end portions 41*a* in the longitudinal direction. Hence, it is possible that the length of the parts of the heat applying coil 43 parallel to the longitudinal direction of the coil supporting member 43*a* is shortened as much as possible, and the heat generation area for the image width can be secured with a simple structure.

In this example of the embodiment, owing to a simple structure such that, in the parts of the heat applying coil 43 parallel to the longitudinal direction of the coil supporting member 43*a*, the coil wire is wound round in such a way that the long axis of the coil wire cross-section a1 is parallel to the tangent of the circumference of the coil supporting member at the position, and in the parts lying along the circumference of the coil supporting member, the coil wire is wound round in such a way that the short axis of the coil wire cross-section b1 is parallel to the tangent of the circumference of the coil supporting member at the position, a sufficient heat generation area can be secured.

Further, in the parts lying along the circumference of the coil supporting member 43*b*, as shown in FIG. 8, the heat applying coil 43 may be formed by winding a wire round in such a way that the wire cross-section rises up gradually as it comes nearer to the end portion 42*b* of the coil supporting member 42. In this case, the distribution of heat generation in the fixing roller 41 is improved, which makes it possible to suppress the gradual temperature drop toward the end portion 41*a* in the longitudinal direction to a much smaller extent.

Further, the cross-sectional shape of the wire of the heat applying coil 43 is not limited to the shape of the elongated circle, but such ones as shown in FIG. 9(*a*) to FIG. 9(*c*) can be employed; FIG. 9(*a*) shows one having a rectangular shape, FIG. 9(*b*) shows one having an elliptical shape, and FIG. 9(*c*) shows one having an oval shape.

Figure 10:
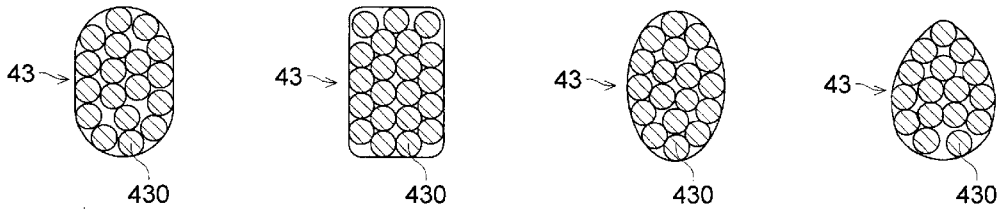
FIG. 10(*a*) to FIG. 10(*d*) are drawings showing the cross-sectional shapes of bundles of wires of heat applying coils composed of a plurality of wires with a small diameter.

As shown in FIG. 10(*a*) to FIG. 10(*d*), the heat applying coil 43 may be made up of a composite wire composed of a plurality of small-diameter wires 430; FIG. 10(*a*) shows one having a cross-section of the shape of an elongated circle, FIG. 10(*b*) shows one having a cross-section of a rectangular shape, FIG. 10(*c*) shows one having a cross-section of an elliptical shape, and FIG. 10(*d*) shows one having a cross-section of an oval shape.

Figure 11:
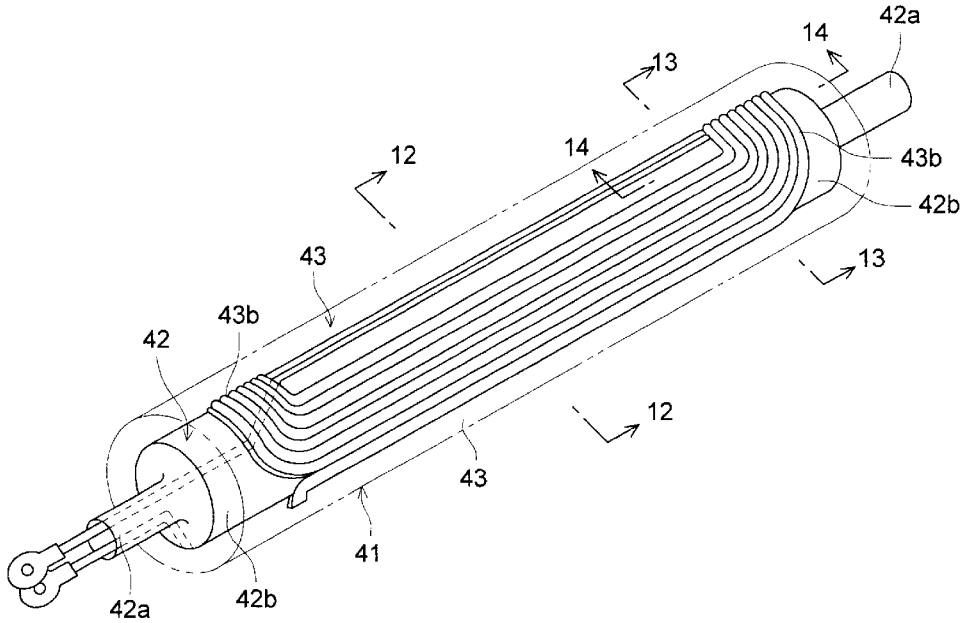
FIG. 11 is a perspective view showing a state in which a heat applying coil is formed by winding a wire round on a coil supporting member.
Figure 12:
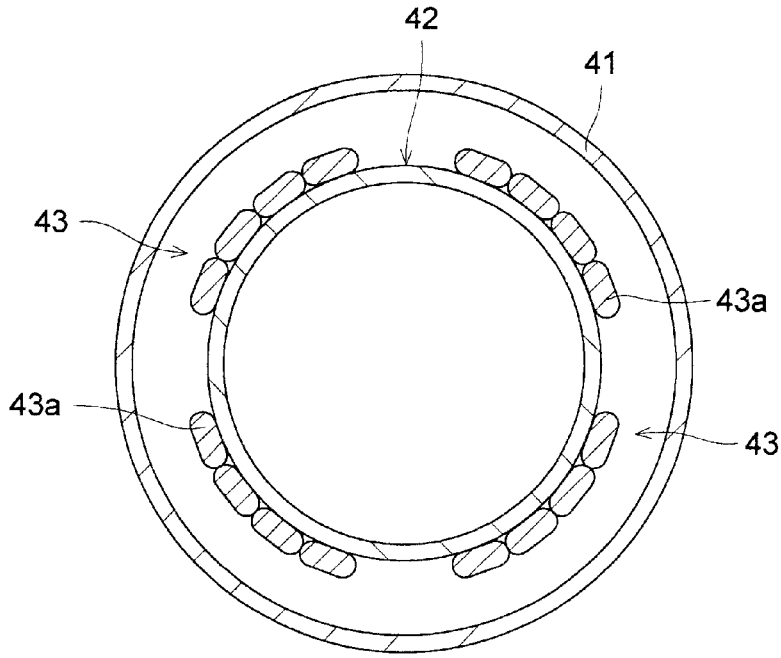
FIG. 12 is the cross-sectional view at the line 12—12 in FIG. 11.
Figure 13:
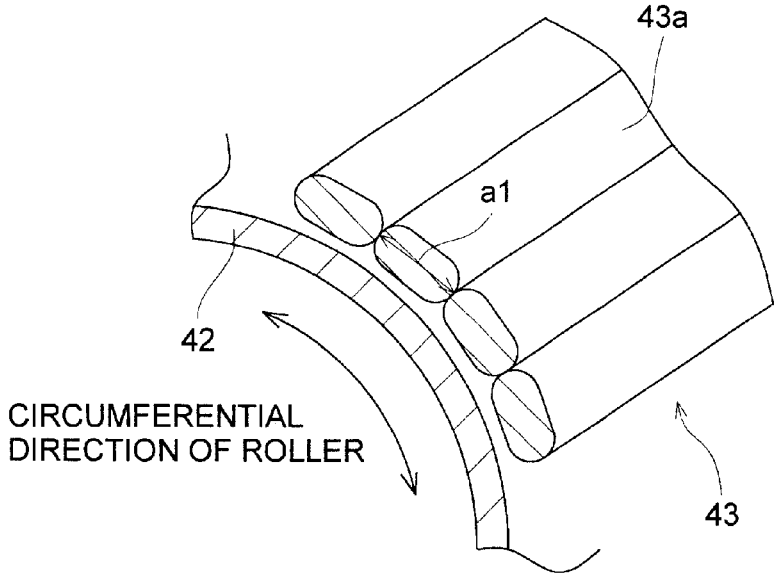
FIG. 13 is the cross-sectional view at the line 13—13 in FIG. 11.
Figure 14:
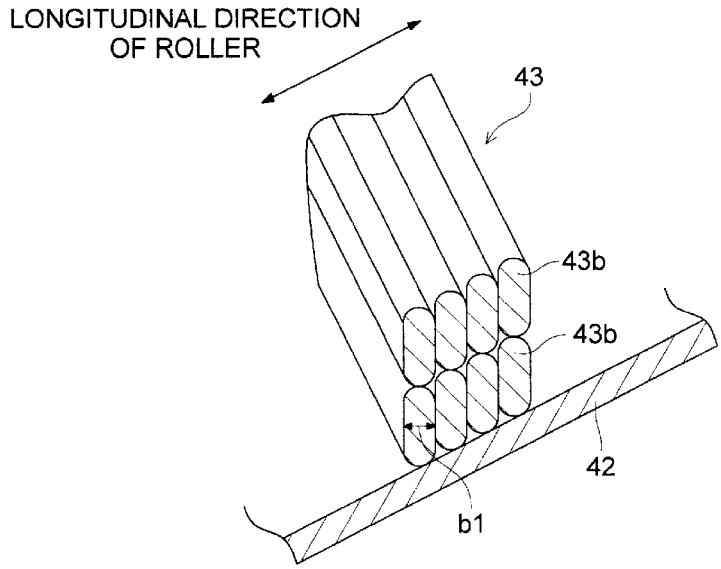
FIG. 14 is the cross-sectional view at the line 14—14 in FIG. 11.

As a means for making the winding density of the parts lying along the circumference of the coil supporting member 43*b* higher than the winding density of the parts parallel to the longitudinal direction of the coil supporting member 43*a*, such structures as shown in FIG. 11 to FIG. 14 can be employed. FIG. 11 is a perspective view showing a state in which a heat applying coil is formed by winding a wire round on a coil supporting member, FIG. 12 is the cross-sectional view at the line 12—12, FIG. 13 is the cross-sectional view at the line 13—13, and FIG. 14 is the cross-sectional view at the line 14—14.

The heat applying coil 43 of this example of the embodiment has different number of stacked layers of the coil wire between the parts parallel to the longitudinal direction of the coil supporting member 43*a* and the parts lying along the circumference of the coil supporting member 43*b*; the number of stacked layers in the parts parallel to the longitudinal direction of the coil supporting member 43*a* is one, and the number of stacked layers in the parts lying along the circumference of the coil supporting member 43*b* is two.

As described in the above, by making the number of stacked layers in the parts lying along the circumference of the coil supporting member 43*b* greater than the number of stacked layers in the parts parallel to the longitudinal direction of the coil supporting member 43*a*, the magnetic flux density at the end portions 41*a* of the fixing roller 41 in the longitudinal direction is made high, and heat generation is increased to a degree depending on it; thus, the distribution of heat generation in the fixing roller 41 is improved, which makes it possible to suppress the temperature drop at the end portions 41*a* in the longitudinal direction. The cross-sectional shape of the wire of the heat applying coil 43 in this example of the embodiment is not limited to the shape of an elongated circle, but such ones as shown in FIG. 9(*a*) to FIG. 9(*c*) can be employed. Further, as of a plurality of small-diameter wires 430 may be used, and one having a cross-sectional shape such as a circle with its vertical axis and lateral axis crossing at the center of the cross-section made equal to each other.

Figure 15:
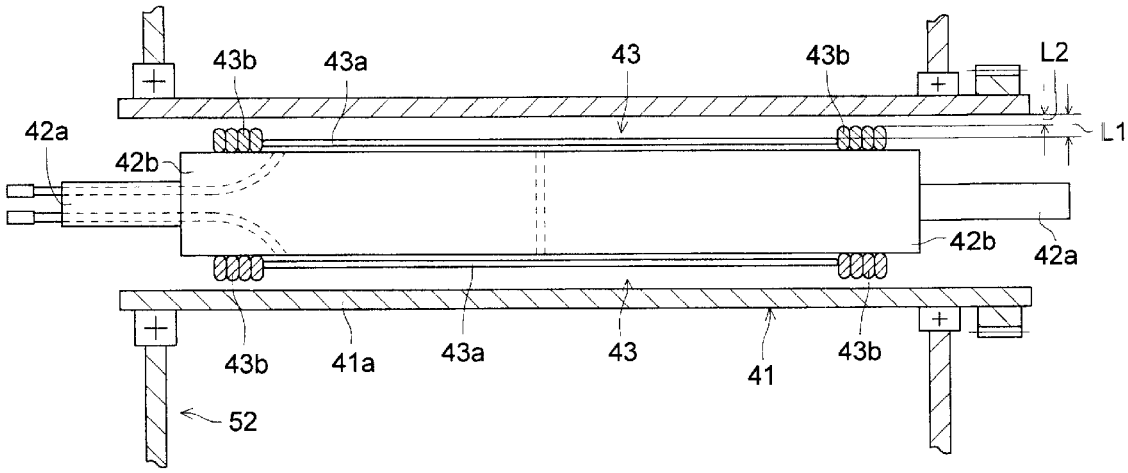
FIG. 15 is a drawing showing the distance between the outer surface of the wound wire in a part of a heat applying coil lying along the circumference of the coil supporting member and the inner surface of the fixing roller.
Figure 16:
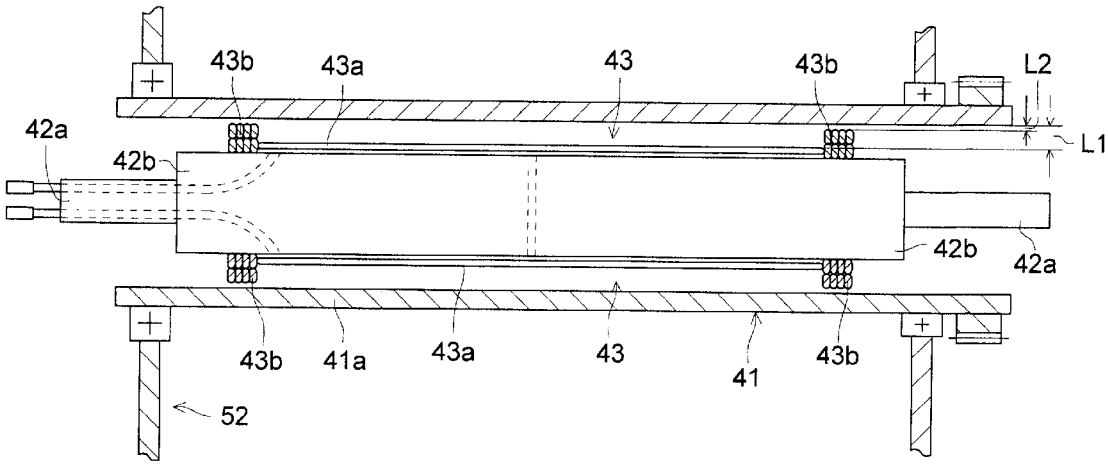
FIG. 16 is a drawing of another example of practice showing the distance between the outer surface of the wound wire in a part of a heat applying coil lying along the circumference of the coil supporting member and the inner surface of the fixing roller.

In the example of the embodiment shown in FIG. 2 to FIG. 7, as shown in FIG. 15, for the heat applying coil 43, a distance L2 between the outer surface of the wound wire in the parts lying along the circumference of the coil supporting member 43*b* and the inner surface of the fixing roller 41 is made shorter than a distance Li between the outer surface of the wound wire in the parts parallel to the longitudinal direction of the coil supporting member 43*a* and the inner surface of the fixing roller 41. In the example of the embodiment shown in FIG. 11 to FIG. 14, as shown in FIG. 16, for the heat applying coil 43, a distance L2 between the outer surface of the wound wire in the parts lying along the circumference of the coil supporting member 43*b* and the inner surface of the fixing roller 41 is made further shorter than shown in FIG. 10(*a*) to FIG. 10(*d*), a composite wire composed a distance L1 between the outer surface of the wound wire in the parts parallel to the longitudinal direction of the coil supporting member 43*a* and the inner surface of the fixing roller 41.

As described in the above, by making the distance L2 between the outer surface of the wound wire in the parts lying along the circumference of the coil supporting member 43*b* and the inner surface of the fixing roller 41 shorter than the distance L1 between the outer surface of the wound wire in the parts parallel to the longitudinal direction of the coil supporting member 43*a* and the inner surface of the fixing roller 41, the magnetic flux density at the end portions 41*a* of the fixing roller 41 in the longitudinal direction is made higher, and heat generation is increased accordingly; thus, the distribution of heat generation in the fixing roller 41 is improved, which makes it possible to suppress the temperature drop at the end portions 41*a* in the longitudinal direction.

Figure 17:
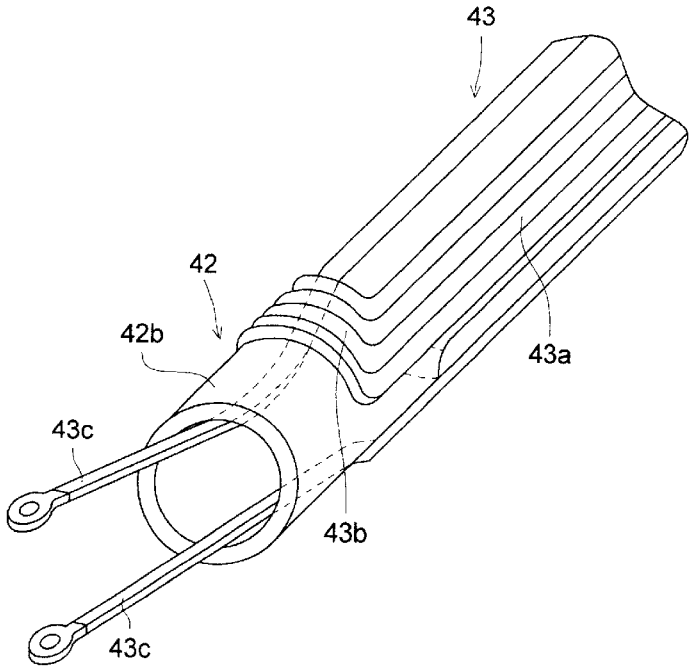
FIG. 17 is a perspective view showing how the lead wires of a heat applying coil are drawn out.
Figure 18:
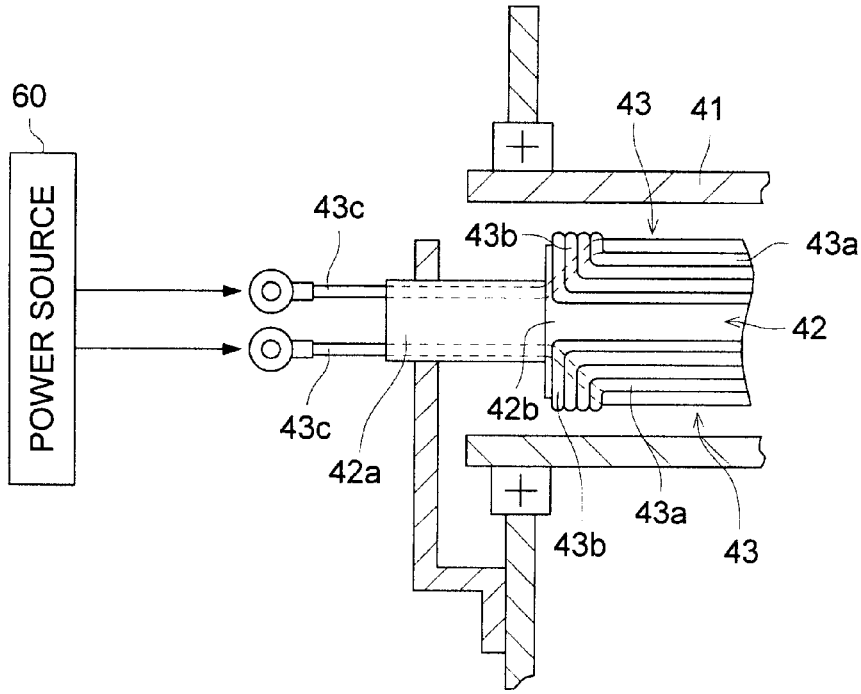
FIG. 18 is a cross-sectional view showing the supporting portion of a coil supporting member.
Figure 19:
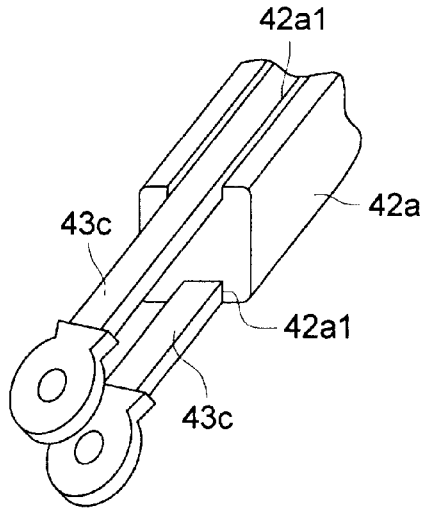
FIG. 19 is a perspective view of the end portion of a coil supporting member showing how the lead wires of a heat applying coil are drawn out.

In FIG. 17 to FIG. 19, it is shown how the lead wires of the heat applying coil 43 are drawn out. FIG. 17 is a perspective view showing how the lead wires of a heat applying coil are drawn out, FIG. 18 is a cross-sectional view showing the supporting portion of a coil supporting member, and FIG. 19 is a perspective view of an end portion of a coil supporting member showing how the lead wires of a heat applying coil are drawn out.

The lead wires 43*c* of the heat applying coil 43 are made to come to the inside of the winding of the heat applying coil 43 at an end portion 42*b* of the coil supporting member 42, are inserted into the inside of the end portion 42*b* to be drawn out, and are fitted into slots 42*a*l of an end supporting portion 42*a*. By disposing these lead wires 43*c* of the heat applying coil 43 inside the winding of the heat applying coil 43, the lead wires 43*c* do not obstruct the formation of the heat applying coil 43 by winding a wire round, and on top of it, connection to a power source 60 can be carried out easily.

By making the lead wires 43*c* of the heat applying coil 43 fixed to the coil supporting member 42, drawing them out from one side in the longitudinal direction of the coil supporting member to connect them to the power source 60, and doing it from only one side in the longitudinal direction of the coil supporting member, they can be connected to the power source 60 simply and certainly, and on top of it, the efficiency of operation in assembly is improved.

Figure 20:
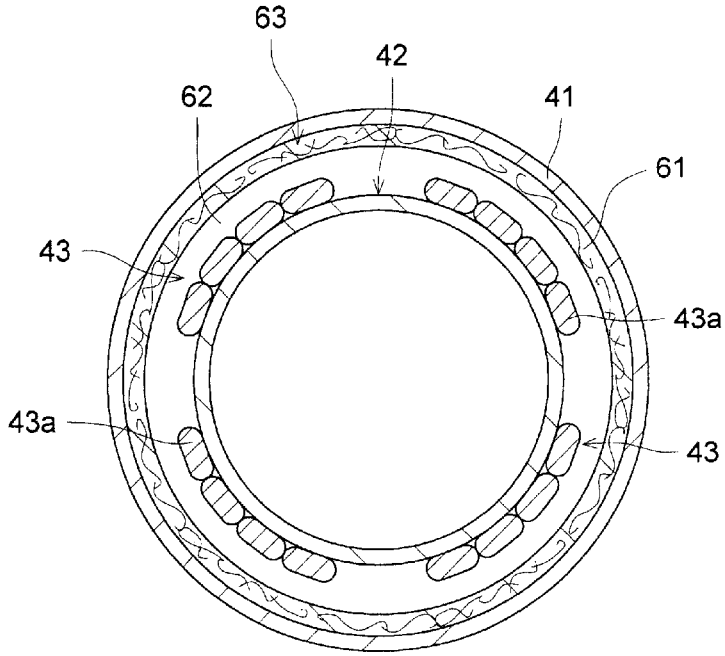
FIG. 20 is a drawing showing an example of the embodiment of this invention having a heat insulating layer formed between the heat applying coil and the fixing roller.
Figure 21:
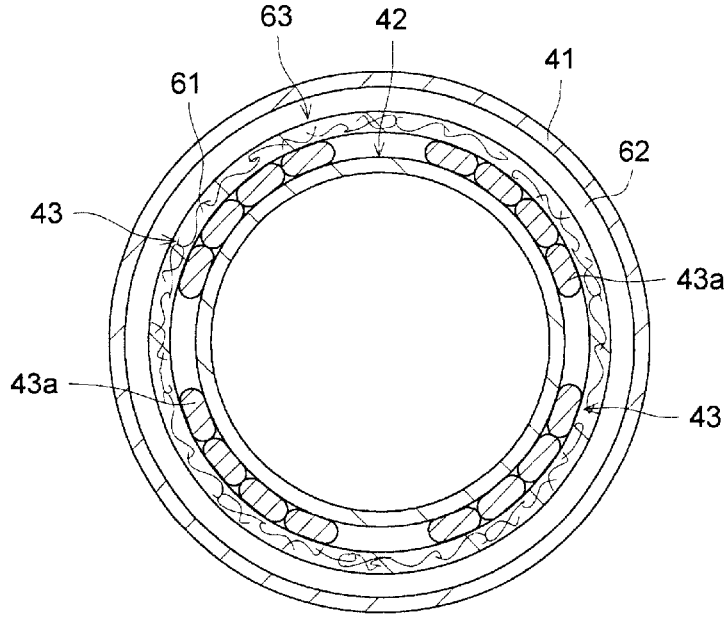
FIG. 21 is a drawing showing another example of the embodiment of this invention having a heat insulating layer formed between the heat applying coil and the fixing roller.

FIG. 20 and FIG. 21 show examples of the embodiment in which a heat insulating layer is formed between the heat applying coil 43 and the fixing roller 41. In the example of the embodiment shown in FIG. 20, a heat insulating member 61 is provided on the inner surface of the fixing roller 41, and an air space 62 is provided between the heat insulating member 61 and the heat applying coil 43, to form a heat insulating layer 63. In the example of the embodiment shown in FIG. 21, a heat insulating member 61 is provided on the surface of the heat applying coil 43, and an air space 62 is provided between the heat insulating member 61 and the fixing roller 41, to form a heat insulating layer 63.

As described in the above, by forming a heat insulating layer 63 between the heat applying coil 43 and the fixing roller 41, heat radiation from the fixing roller 41 can be reduced; thus, stable fixing is possible and power consumption can be reduced.

Figure 22:
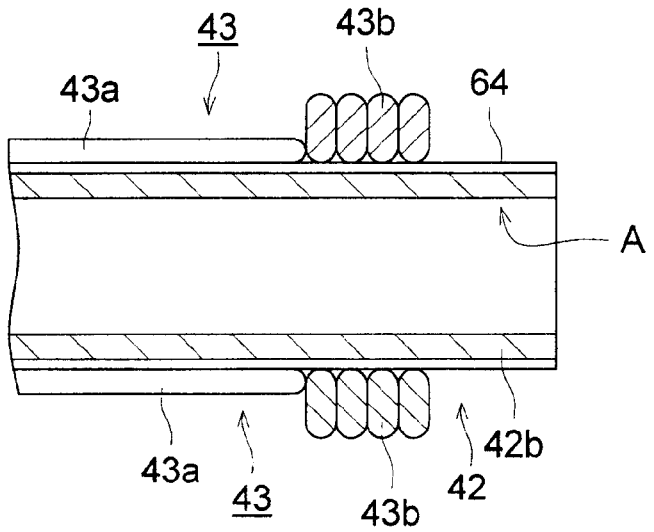
FIG. 22 is a drawing showing an example of the embodiment of this invention of means for radiating heat of a heat applying coil.
Figure 23:
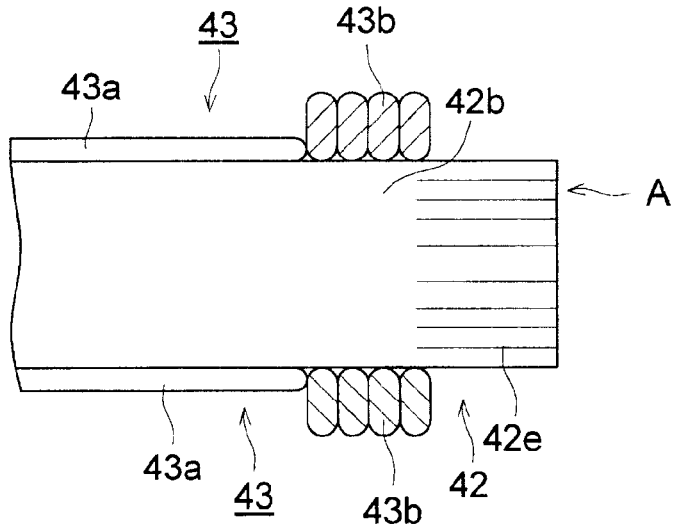
FIG. 23 is a drawing showing an example of the embodiment of this invention of means for radiating heat of a heat applying coil.

FIG. 22 and FIG. 23 show examples of the embodiment in which the coil supporting member 42 is made of a thermally conductive material, and means A for radiating heat of the heat applying coil 43 is provided. In the example of the embodiment shown in FIG. 22, the coil supporting member 42 is made of a metallic material of high thermal conductivity such as aluminum, and an insulating layer 64 is laminated on the surface of the coil supporting member 42. In the example of the embodiment shown in FIG. 23, a heat radiating fin 42e is provided at the end portion 42*b* of the coil supporting member 42. In this way, by making the coil supporting member 42 of a thermally conductive material to radiate heat of the heat applying coil 43, the durability of the coil supporting member 42 and the heat applying coil 43 can be improved.

FIG. 24(*a*) and FIG. 24(*b*) are drawings showing another example of the embodiment of this invention of a state in which a heat applying coil is formed by winding a wire round on a coil supporting member. In this example of the embodiment, as shown in FIG. 24(*a*), the coil supporting member 42 is composed of half-divisional parts 42A and 42B which are obtained by dividing the coil supporting member 42 into two parts in its longitudinal direction, heat applying coils 43A and 43B are formed by winding wires round respectively on the half-divisional parts 42A and 42B from inner side to the outer side to cover the whole of the half-divisional parts 42A and 42B, in such a way that the terminals at the start of winding come to the inner side, the both half-divisional parts are bonded to each other as shown in FIG. 24(*b*), and the one and the other of the ends of winding 43A1 and 43B1 at the outside of the heat applying coils 43A and 43B are connected to each other, to form a single heat applying coil 43.

In this example of the embodiment, by making a single heat applying coil 43 divided into tow heat applying coils 43A and 43B, if the both heat applying coils are formed by winding a wire round in the same shape as shown in FIG. 25(*a*), the terminals 43A2 and 43B2 are parted to the both sides when the both ends of winding 43A1 and 43B1 are connected to each other. For this reason, as shown in FIG. 25(*b*), by folding the both ends 43A1 and 43B1 to let them pass through the inside and connecting them at the inside of the coil, the terminals 43A2 and 43B2 come to the same side.

As described in the above, by winding wires round to form the heat applying coils 43A and 43B on the half-divisional parts 42A and 423 from the inner side to the outer side with their starting ends of winding put at inner side, to make two winding units, bonding both half-divisional parts 42A and 42B to each other, and connecting the respective outer side ends 43A1 and 43B1 of the heat applying coils 43A and 43B to each other, assembly is easily done, and the efficiency of operation in the assembly is improved.

As shown in FIG. 1, the image forming apparatus of this example of the embodiment makes image exposure for the photoreceptor drum 10, forms a latent image on the photoreceptor drum 10, develops this latent image to form a toner image, transfers this toner image onto the recording paper sheet P as a transfer material, and fixes the toner image by the fixing device 30 shown in FIG. 25(*b*).

Figure 26:
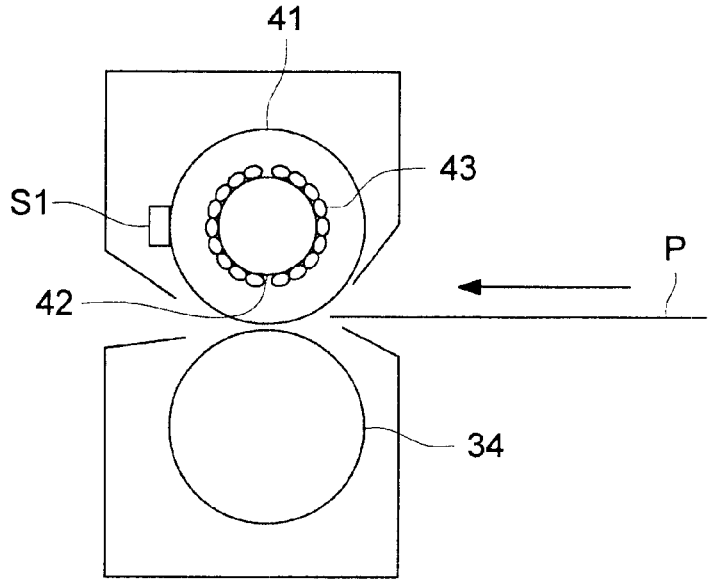
FIG. 26 is a drawing showing the detection of a temperature of a heat applying coil by a temperature sensor.
Figure 27:
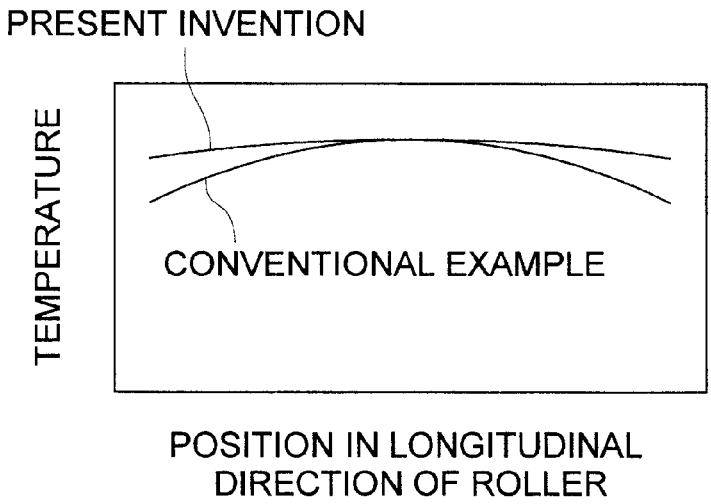
FIG. 27 is a drawing showing temperature variation vs. position in the longitudinal direction of a roller.

In this fixing device 30, as shown in FIG. 26, if the temperature distribution in the fixing roller 41 is detected by a temperature sensor S1, as shown in FIG. 27, it shows an approximately uniform temperature distribution in the longitudinal direction of the roller, and it is found that the temperature drop at the end portions in the longitudinal direction of the roller, which has heretofore been observed, is prevented. In this way, by providing a fixing apparatus 30 which is small-sized and of low cost and is capable of securing an enough heat generation area, it is possible to make the image forming apparatus small-sized and of low cost to a degree depending on it.

The explanation about the coil having hollow core (without core) has been made in the foregoing. Further, a coil unit employing a core made of ferrite or amorphous also may be used.

As described in the foregoing, according to the invention of structure 1, by making the winding density in the parts lying along the circumference of the coil supporting member higher than the winding density in the parts parallel to the longitudinal direction of the coil supporting member, the magnetic flux density at the end portions in the longitudinal direction of the fixing roller is made higher, and heat generation becomes higher in proportion to it, thus the distribution of heat generation in the fixing roller is improved whereby making it possible to suppress the temperature drop at the end portions in the longitudinal direction, and it is possible that the length of the heat applying coil is made as short as possible, a sufficient heat generation area is secured with a simple structure, and the size is made small and the manufacturing cost is lowered.

According to the invention of structure 2, by winding the coil wire in such a way that, in the parts of the heat applying coil parallel to the longitudinal direction of the coil supporting member, the long axes of the coil wire cross-section are directed to one another, and in the parts lying along the circumference of the coil supporting member, the short axes of the coil wire cross-section are directed to one another, the magnetic flux density at the end portions in the longitudinal direction of the fixing roller is made higher, and heat generation becomes higher accordingly, thus the distribution of heat generation in the fixing roller is improved whereby making it possible to suppress the temperature drop at the end portions in the longitudinal direction, and it is possible that the length of the heat applying coil is made as short as possible, a sufficient heat generation area is secured with a simple structure, and the size is made small and the manufacturing cost is lowered.

According to the invention of structure 3, by making the number of stacked layers in the parts of the heat applying coil lying along the circumference of the coil supporting member greater than the number of stacked layers in the parts parallel to the longitudinal direction of the coil supporting member, the magnetic flux density at the end portions in the longitudinal direction of the fixing roller is made higher, and heat generation becomes higher accordingly, thus the distribution of heat generation in the fixing roller is improved whereby making it possible to suppress the temperature drop at the end portions in the longitudinal direction, and it is possible that the length of the heat applying coil is made as short as possible, a sufficient heat generation area is secured with a simple structure, and the size is made small and the manufacturing cost is lowered.

According to the invention of structure 4, by making the distance between the outer surface of the wound wire in the parts of the heat applying coil lying along the circumference of the coil supporting member and the inner surface of the fixing roller shorter than the distance between the outer surface of the wound wire in the parts of the heat applying coil parallel to the longitudinal direction of the coil supporting member and the inner surface of the fixing roller, the magnetic flux density at the end portions in the longitudinal direction of the fixing roller is made higher, and heat generation becomes higher in proportion to it, thus the distribution of heat generation in the fixing roller is improved whereby making it possible to suppress the temperature drop at the end portions in the longitudinal direction, and it is possible that the length of the heat applying coil is made as short as possible, a sufficient heat generation area is secured with a simple structure, and the size is made small and the manufacturing cost is lowered.

According to the invention of structure 5, by placing the lead wires of the heat applying coil inside the winding of the heat applying coil, the lead wires do not stand in the way of the heat applying coil wire to be wound round to form the coil, and on top of it, they are easily connected to a power source.

According to the invention of structure 6, by making the coil supporting member heat resistant and its both ends supported fixedly, the durability of the coil supporting member is improved.

According to the invention of structure 7, by making the lead wires of the heat applying coil fixed to the coil supporting member and drawing out from one side of the coil supporting member in the longitudinal direction, the lead wires can be connected to a power source simply and certainly, and on top of it, the efficiency of operation in assembly is improved.

According to the invention of structure 8, by forming a heat insulating layer between the heat applying coil and the fixing roller, heat radiation from the fixing roller is decreased, which makes possible stable fixing and reduction of power consumption.

According to the invention of structure 9, by making the coil supporting member thermally conductive to radiate heat of the heat applying coil, the durability of the coil supporting member and the heat applying coil can be improved.

According to the invention of structure 10, by winding round the heat applying coil wires on the half-divisional parts respectively from inner side to the outer side, in such a way that the terminals at the start of winding come to the inner side, to build two winding units, bonding the both half-divisional parts to each other, and connecting the one and the other of the ends of winding at the outer side of the heat applying coils to each other, they are easily built and the efficiency of the operation of assembly is improved.

According to the invention of structure 11, by being equipped with a fixing device which is small-sized, of low cost, and capable of securing a sufficient heat generating area, the image forming apparatus can be made small-sized and of low cost to a degree depending on it.

What is claimed is:

1. A fixing device comprising:

(a) a cylindrical fixing roller to be heated;

(b) a coil supporting member disposed along an inside of the fixing roller;

(c) a heat applying coil formed by winding a wire around a circumference of the coil supporting member for heating the fixing roller by inducing an induced current in the fixing roller; and (d) a pressing roller for forming a nip portion with the fixing roller, and for conveying a transfer material which is gripped by the nip portion between the fixing roller and the pressing roller, so that a toner image formed on the transfer material is fixed by heat energy from the fixing roller, wherein the heat applying coil is formed by winding the wire in a longitudinal direction of the coil supporting member so as to have a shape which has parts lying parallel to the longitudinal direction of the coil supporting member and parts lying along the circumference of the coil supporting member, and so that a winding density of the parts lying along the circumference of the coil supporting member is made higher than a winding density of the parts lying parallel to the longitudinal direction of the coil supporting member; and wherein the wire of the heat applying coil has a cross-sectional shape such that a length of a major axis and a length of a minor axis intersecting each other perpendicularly at a center of the cross-sectional shape are different from each other, and the heat applying coil is formed by winding the wire so that adjoining major axes of the cross-sectional shape face each other in the parts lying parallel to the longitudinal direction of the coil supporting member, and so that adjoining minor axes of the cross-sectional shape face each other in the parts lying along the circumference of the heat applying coil.

2. The fixing device of claim 1, wherein a distance between an outer surface of the wire in the parts of the heat applying coil lying along the circumference of the coil supporting member and an inner surface of the fixing roller is made shorter than a distance between an outer surface of the wire in the parts of the heat applying coil lying parallel to the longitudinal direction of the coil supporting member and the inner surface of the fixing roller.

3. The fixing device of claim 1, wherein lead wires of the heat applying coil are disposed inside the winding of the heat applying coil.

4. The fixing device of claim 1, wherein the coil supporting member is heat resistant, and both ends thereof are supported fixedly.

5. The fixing device of claim 1, wherein lead wires of the heat applying coil are fixed to the coil supporting member, and are drawn out from one side of the coil supporting member in the longitudinal direction, to be connected to a power source.

6. The fixing device of claim 1, wherein a heat insulating layer is formed between the heat applying coil and the fixing roller.

7. The fixing device of claim 1, wherein the coil supporting member is formed from a heat conducting material and radiates heat of the heat applying coil.

8. The fixing device of claim 1, wherein the coil supporting member comprises half-divisional parts which are obtained by dividing the coil supporting member into two parts along the longitudinal direction thereof, two parts of the heat applying coil are formed by winding wires around the respective half-divisional parts of the coil supporting member from an inner side to an outer side so that terminals at a start of winding come to the inner side, the half-divisional parts of the coil supporting member are bonded to each other, and first and second ends of the wound wires at the outer side of the two parts of the heat applying coil are connected to each other.

9. A fixing device comprising:

(a) a cylindrical fixing roller to be heated;

(b) a coil supporting member disposed along an inside of the fixing roller;

(c) a heat applying coil formed by winding a wire around a circumference of the coil supporting member for heating the fixing roller by inducing an induced current in the fixing roller; and (d) a pressing roller for forming a nip portion with the fixing roller, and for conveying a transfer material which is gripped by the nip portion between the fixing roller and the pressing roller, so that a toner image formed on the transfer material is fixed by heat energy from the fixing roller, wherein the heat applying coil is formed by winding the wire in a longitudinal direction of the coil supporting member so as to have a shape which has parts lying parallel to the longitudinal direction of the coil supporting member and parts lying along the circumference of the coil supporting member, and so that a winding density of the parts lying along the circumference of the coil supporting member is made higher than a winding density of the parts lying parallel to the longitudinal direction of the coil supporting member; and wherein a number of stacked layers of the heat applying coil are different between the parts lying parallel to the longitudinal direction of the coil supporting member and the parts lying along the circumference of the coil supporting member, and the number of stacked layers in the parts lying along the circumference of the coil supporting member is made greater than the number of stacked layers in the parts lying. parallel to the longitudinal direction of the coil supporting member.

10. The fixing device of claim 9, wherein a distance between an outer surface of the wire in the parts of the heat applying coil lying along the circumference of the coil supporting member and an inner surface of the fixing roller is made shorter than a distance between an outer surface of the wire in the parts of the heat applying coil lying parallel to the longitudinal direction of the coil supporting member and the inner surface of the fixing roller.

11. The fixing device of claim 9, wherein lead wires of the heat applying coil are disposed inside the winding of the heat applying coil.

12. The fixing device of claim 9, wherein the coil supporting member is heat resistant, and both ends thereof are supported fixedly.

13. The fixing device of claim 9, wherein lead wires of the heat applying coil are fixed to the coil supporting member, and are drawn out from one side of the coil supporting member in the longitudinal direction, to be connected to a power source.

14. The fixing device of claim 9, wherein a heat insulating layer is formed between the heat applying coil and the fixing roller.

15. The fixing device of claim 9, wherein the coil supporting member is formed from a heat conducting material and radiates heat of the heat applying coil.

16. The fixing device of claim 9, wherein the coil supporting member comprises half-divisional parts which are obtained by dividing the coil supporting member into two parts along the longitudinal direction thereof, two parts of the heat applying coil are formed by winding wires around the respective half-divisional parts of the coil supporting member from an inner side to an outer side so that terminals at a start of winding come to the inner side, the half-divisional parts of the coil supporting member are bonded to each other, and-first and second ends of the wound wires at the outer side of the two parts of the heat applying coil are connected to each other.

17. An image forming apparatus in which a uniformly charged photoreceptor drum is imagewise exposed, a latent image is formed on the photoreceptor drum, the latent image is developed to form a toner image, and the toner image is transferred onto a transfer material and fixed thereon, the image forming apparatus including a fixing device comprising:

(a) a cylindrical fixing roller to be heated;

(b) a coil supporting member disposed along an inside of the fixing roller;

(c) a heat applying coil formed by winding a wire around a circumference of the coil supporting member for heating the fixing roller by inducing an induced current in the fixing roller; and (d) a pressing roller for forming a nip portion with the fixing roller, and for conveying a transfer material which is gripped by the nip portion between the fixing roller and the pressing roller, so that a toner image formed on the transfer material is fixed by heat energy from the fixing roller, wherein the heat applying coil is formed by winding the wire in a longitudinal direction of the coil supporting member so as to have a shape which has parts lying parallel to the longitudinal direction of the coil supporting member and parts lying along the circumference of the coil supporting member, and so that a winding density of the parts lying along the circumference of the coil supporting member is made higher than a winding density of the parts lying parallel to the longitudinal direction of the coil supporting member; and wherein the wire of the heat applying coil has a cross-sectional shape such that a length of a major axis and a length of a minor axis intersecting each other perpendicularly at a center of the cross-sectional shape are different from each other, and the heat applying coil is formed by winding the wire so that adjoining major axes of the cross-sectional shape face each other in the parts lying parallel to the longitudinal direction of the coil supporting member, and so that adjoining minor axes of the cross-sectional shape face each other in the parts lying along the circumference of the heat applying coil.

18. An image forming apparatus in which a uniformly charged photoreceptor drum is imagewise exposed, a latent image is formed on the photoreceptor drum, the latent image is developed to form a toner image, and the toner image is transferred onto a transfer material and fixed thereon, the image forming apparatus including a fixing device comprising:

(a) a cylindrical fixing roller to be heated;

(b) a coil supporting member disposed along an inside of the fixing roller;

(c) a heat applying coil formed by winding a wire around a circumference of the coil supporting member for heating the fixing roller by inducing an induced current in the fixing roller; and (d) a pressing roller for forming a nip portion with the fixing roller, and for conveying a transfer material which is gripped by the nip portion between the fixing roller and the pressing roller, so that a toner image formed on the transfer material is fixed by heat energy from the fixing roller, wherein the heat applying coil is formed by winding the wire in a longitudinal direction of the coil supporting member so as to have a shape which has parts lying parallel to the longitudinal direction of the coil supporting member and parts lying along the circumference.of the coil supporting member, and so that a winding density of the parts lying along the circumference of the coil supporting member is made higher than a winding density of the parts lying parallel to the longitudinal direction of the coil supporting member; and wherein a number of stacked layers of the heat applying coil are different between the parts lying parallel to the longitudinal direction of the coil supporting member and the parts lying along the circumference of the coil supporting member, and the number of stacked layers in the parts lying along the circumference of the coil supporting member is made greater than the number of stacked layers in the parts lying parallel to the longitudinal direction of the coil supporting member.

* * * * *